United States Patent [19]

Augsburger

[11] 4,372,197

[45] Feb. 8, 1983

[54] COLD WEATHER INLET FOR VENTILATING SYSTEMS

[75] Inventor: Norman D. Augsburger, Muskogee, Okla.

[73] Assignee: Acme Engineering & Manufacturing Corporation, Muskogee, Okla.

[21] Appl. No.: 206,839

[22] Filed: Nov. 14, 1980

[51] Int. Cl.[3] ..... F24F 13/18; F16K 49/00

[52] U.S. Cl. ..... 98/118; 98/33 A; 137/341; 219/201

[58] Field of Search ..... 98/32, 33 R, 33 A, 37, 98/39, 40 C, 116, 118; 137/59, 301, 341; 138/33; 219/200, 201; 236/49

[56] References Cited

U.S. PATENT DOCUMENTS

| | | | |
|---|---|---|---|
| 2,699,106 | 1/1955 | Hoyer | 98/33 A X |
| 3,524,399 | 8/1970 | Bohanon | 98/33 |
| 3,575,199 | 4/1971 | Beattie | 219/201 X |
| 3,658,085 | 4/1972 | Cannella | 219/201 X |
| 3,733,459 | 5/1973 | Lengstorf | 138/33 X |
| 4,110,603 | 8/1978 | Peterson et al. | 137/341 |
| 4,214,147 | 7/1980 | Kraver | 137/341 X |

*Primary Examiner*—Albert J. Makay
*Assistant Examiner*—Harold Joyce
*Attorney, Agent, or Firm*—Staas & Halsey

[57] ABSTRACT

An inlet for use in a ventilating system having a frame defining an opening and provided with an inwardly directed lip, a panel mounted for rotation within the frame and including flanges which abut the lip when the panel is in closed position, an electrical heating cable secured to the frame in the vicinity of the panel, and a system for rotating the panel and energizing the heating cable, when desired.

5 Claims, 5 Drawing Figures

COLD WEATHER INLET FOR VENTILATING SYSTEMS

BACKGROUND AND SUMMARY OF THE INVENTION

It is well known in the art that a variety of ventilating systems, which as an integral part thereof employ motorized inlet shutters, experience difficulty in operating in subfreezing climates, particularly with respect to agricultural applications such as barns in the northern climates. Great difficulty has been experienced with respect to the faulty operation of such motorized inlet shutters because of freezing of the individual blades of the shutters at subzero conditions. The cold weather inlet of the present invention, which can function either by itself merely as an inlet for outside air, or in conjunction with a powered tube ventilation fan, is provided with a single panel mounted for rotating movement within a frame, and an electrical defroster strip appropriately mounted in surrounding relationship with respect to the movable panel, and electrical controls for operating same.

DESCRIPTION OF THE PREFERRED EMBODIMENT

Figure 1:
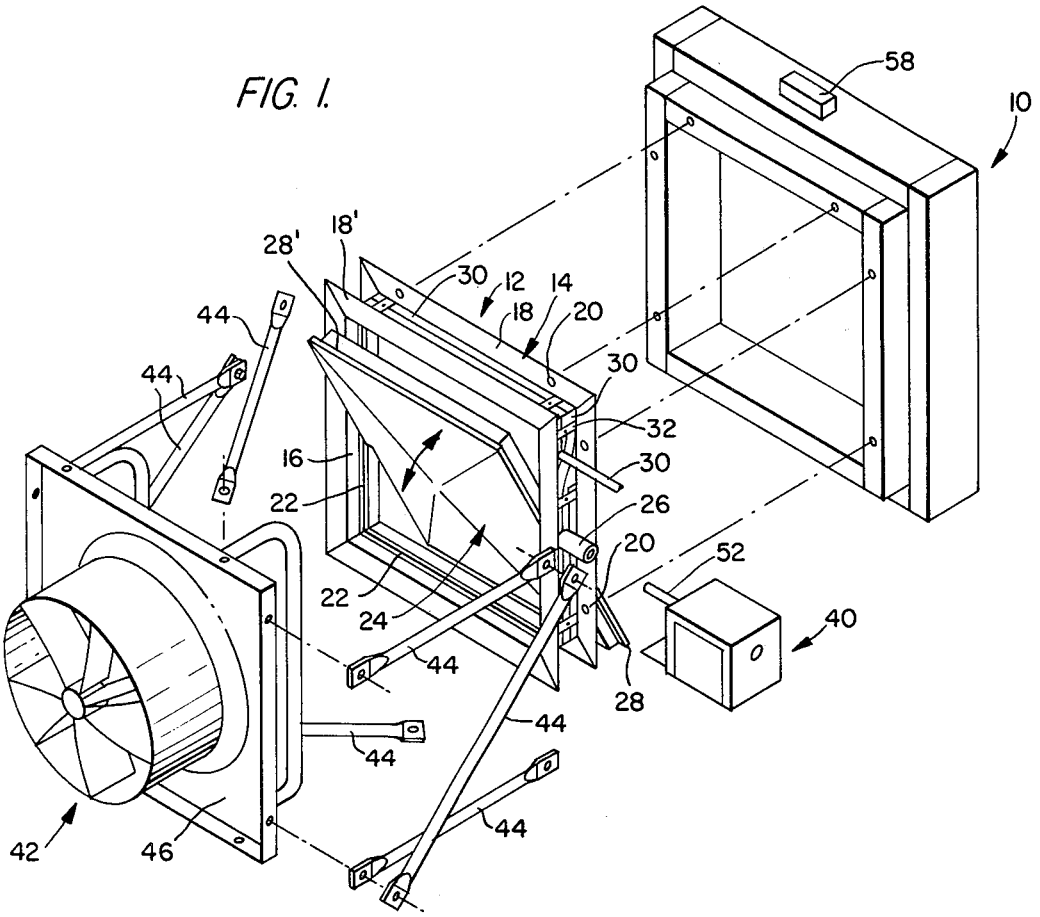
FIG. 1 is an exploded perspective view illustrating the cold weather inlet of the present invention in relation to the framed opening within the wall of the building, and optional use with a powered tube fan.
Figure 2:
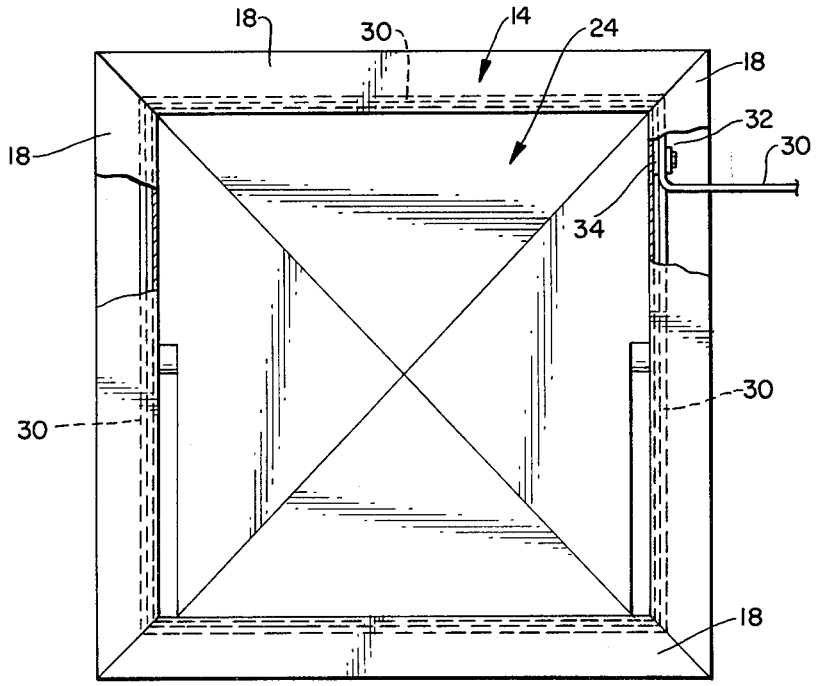
FIG. 2 is a front elevational view of the cold weather inlet, illustrating the electrical heating cable surrounding the movable panel thereof.
Figure 3:
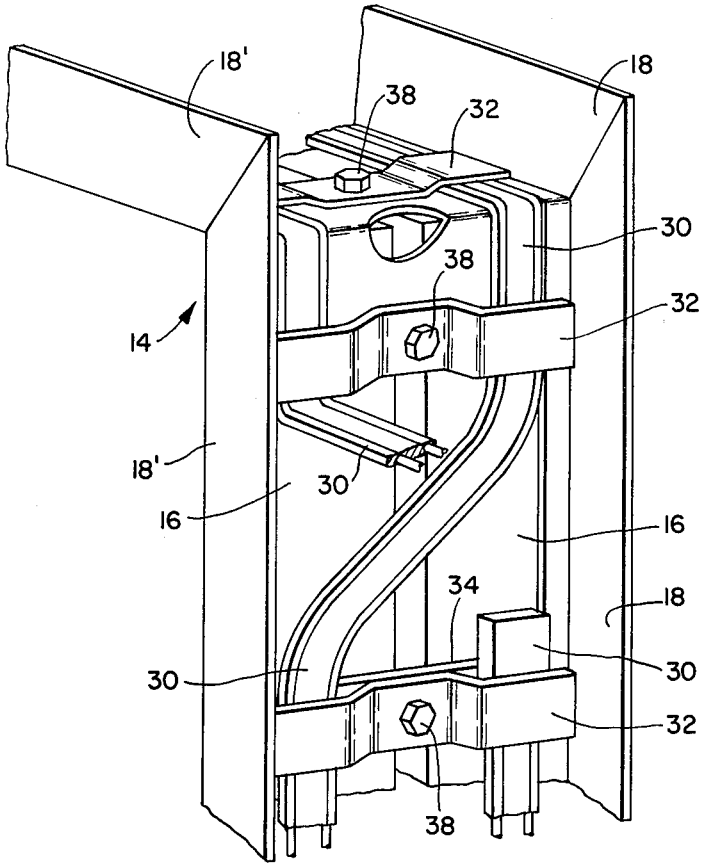
FIG. 3 is a perspective view of one corner of the cold weather inlet, illustrating the manner of wrapping the electrical heating cable around, and attachment of same to, the interior wall sections of the frame of the inlet with spacer strips and brackets.
Figure 4:
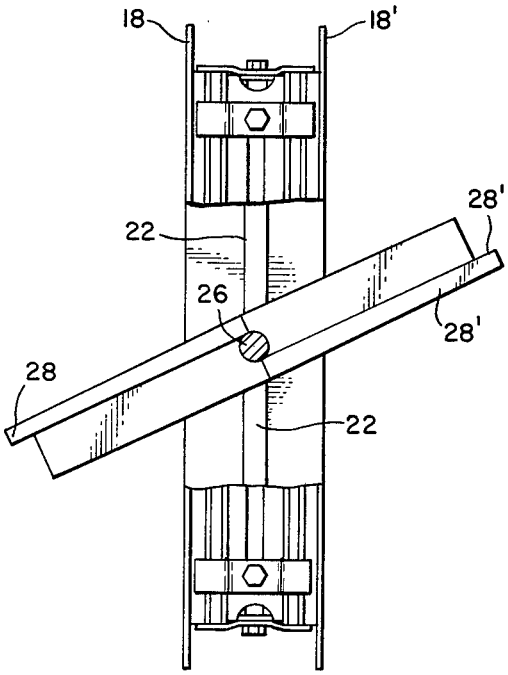
FIG. 4 is a side elevational view of the inlet with a portion of the frame removed, illustrating the arrangement of the sealing flanges of the panel in relation to the lip of the frame.

The cold weather inlet of the present invention is illustrated generally in FIG. 1, wherein the reference numeral 10 designates framing, typically of wood, within the wall of the building, for example, a manufacturing facility, greenhouse or barn, to which the inlet assembly, generally designated by the reference numeral 12, is attached. The cold weather inlet 12 includes a frame, generally designated by the reference numeral 14, having four interior wall sections 16 terminating outwardly in flanges 18 and 18'. The flanges 18 are provided with openings 20 to accommodate fasteners thus permitting the inlet 12 to be secured to the framing 10 within the wall of the building. A lip 22 is provided along the midportion of each of the interior wall sections 16 functioning as a stop for the panel generally designated by the reference numeral 24 when in closed position.

The panel 24 is provided with a shaft 26 appropriately journalled within two of the interior wall sections 16 permitting the panel 24 to rotate through approximately 90°. The panel 24 is constructed so as to provide on opposite sides thereof flanges 28 and 28' which, when the panel 24 is closed, securely engage the corresponding portions of the lip 22 preventing air movement through the inlet 12. The reference numeral 40 designates generally a motor assembly which is operatively connected to the shaft 26 to operate the panel 24. The construction of the motor assembly 40 will be described hereinafter.

An electrical heating cable which functions as a defroster strip is generally designated by the reference numeral 30 and is wrapped around the interior wall sections 16. More particularly, the cable 30 is positioned between brackets 32 and strips 34 which rest against the wall sections 16, the bolts 38 securing the assembled brackets 32, electrical heating cable 30 and strips 34 to the interior wall sections 16. It will be apparent, therefore, that the heating cable 30 does not cross, overlap or touch itself.

Reference numeral 42 designates generally a distribution fan which may be used in conjunction with the cold weather inlet 12 where powered tube ventilation is desired. Reference is made to U.S. Pat. Nos. 3,318,224 and 3,524,399, which disclose pressurized tube fans which run continuously inflating polyethylene tubes and blowing air through openings provided in the tubes in the form of jets uniformly distributing the air throughout the enclosure. It will be apparent that in such installations the distribution fan 42 is mounted within the building a specified distance from, and directly in front of, the cold weather inlet 12. This precise spacing is accomplished with the use of the struts 44 which are attached with appropriate fasteners both to the wall 46 of the distribution fan 42 and to the outside portions of the framing 10.

Figure 5:
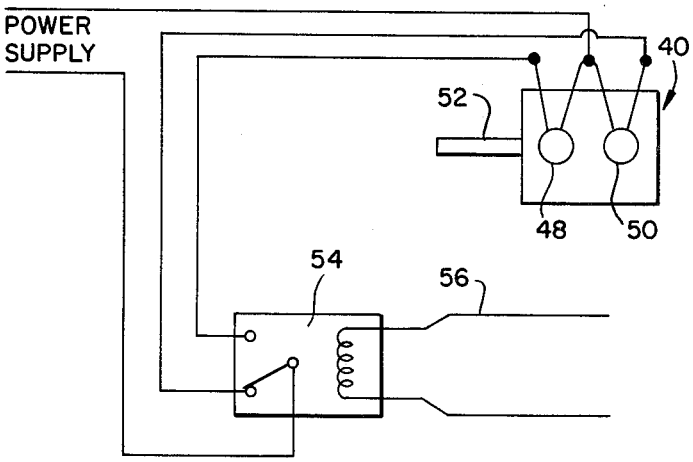
FIG. 5 is a schematic wiring diagram illustrating the motor for opening the panel of the inlet and a representative circuit for operating same.

The system for electrically energizing the motor assembly 40 and heating cable 30 will vary from one installation to another, depending upon the desired results and the relationship of the cold weather inlet 12 to other components of the air moving system. With reference to FIG. 5, it will be apparent that in one arrangement the motor assembly 40 includes a motor 48 for opening the panel 24 and a motor 50 for closing the panel 24, each of the motors being appropriately mounted on the shaft 52 in a manner well known in the art. Operation is controlled by the single pole, double throw relay designated by the reference numeral 54, also of conventional construction and operation. The relay coil 56 enables integration with the entire climate control system of the building, where desired. More particularly, in commercial, agricultural and horticultural applications, a wide variety of climate control may be achieved with powered tube ventilation systems such as disclosed in U.S. Pat. Nos. 3,318,224 and 3,524,399, with the use of control units which may be responsive to temperature and/or humidity conditions, as well as operated in time cycles, permitting varying degrees of heating, recirculation of inside air, ventilation, and evaporative cooling. The electrical heating cable 30 is capable of being operated by itself, or as part of the overall electrical control system, and can be either manually operated or actuated by a thermostat 58, which ideally is set at approximately 32° F. and conveniently located at the top of the frame 10 adjacent the inlet 12 for proper sensing.

I claim:

1. An inlet for use in a ventilating system to permit air to enter a building, comprising:

a frame to be positioned within a wall of the building to define an opening through which air may enter the building, said frame having four wall sections provided with:

flanges extending outwardly therefrom, and lips along the mid portions thereof extending inwardly therefrom into the opening defined by the frame;

a single panel, a shaft journaled for rotation within two of said wall sections and attached to said single panel at the mid portion thereof permitting said panel to rotate within said frame to open and close the opening, said panel including:

a first flange extending outwardly from one side thereof above said shaft, and a second flange extending outwardly from the other side of said panel below said shaft, such that when said panel is in closed position a tight seal exists along the periphery of said single panel at the juncture of said lips which extend inwardly from said four wall sections and said first and second flanges which extend outwardly from opposite sides of said single panel;

an electrical heating cable, means positioning said cable along the periphery of said four wall sections of said frame between said flanges which extend outwardly from said frame such that said cable extends laterally along said frame in close proximity to said lips and said first and second flanges of said panel enabling heating thereof; and means for rotating said single panel and energizing said electrical heating cable.

2. An inlet as in claim 1, wherein said four wall sections of said frame include interior wall portions from which said flanges extend outwardly and wherein said means positioning said cable along the periphery of said four wall sections of said frame comprises a plurality of strips resting in abutting relationship against said interior wall portions of said four wall sections, and a plurality of brackets having central portions resting against said strips, and fastening means securing said central portions of said brackets to said strips and said interior wall portions permitting said electrical heating cable to be positioned between said strips and brackets and wrapped twice around said frame along said interior wall portions of said four wall sections on opposite sides of said lips.

3. An inlet as in claims 1 or 2, wherein said means for energizing said heating cable includes a thermostat for actuating same at a predetermined temperature.

4. An inlet as in claims 1 or 2, wherein said means for rotating said panel comprises a power source, separate motors for rotating said panel in opposite directions, and electrical switching means for operating same.

5. An inlet as in claims 1, 2 or 4, further comprising a powered tube ventilation fan, and means spacing said fan a predetermined distance from said frame and panel to permit air to pass between said fan and frame and panel and enter said fan from all sides thereof when said panel is in closed position and to permit air to pass directly from said frame and panel into said fan when said panel is in open position.

* * * * *